US006305669B1

(12) United States Patent
Harken et al.

(10) Patent No.: US 6,305,669 B1
(45) Date of Patent: Oct. 23, 2001

(54) BEARING BLOCK TETHER USING FINE LINES

(75) Inventors: Olaf T. Harken, Pewaukee; Charles J. Lob, Oconomowoc; Kenneth E. Lange, Brookfield; Thomas G. Hanson, Greenfield, all of WI (US)

(73) Assignee: Harken, Inc., Pewaukee, WI (US)

( * ) Notice: Subject to any disclaimer, the term of this patent is extended or adjusted under 35 U.S.C. 154(b) by 0 days.

(21) Appl. No.: 09/440,435

(22) Filed: Nov. 15, 1999

Related U.S. Application Data

(60) Provisional application No. 60/109,789, filed on Nov. 25, 1998.

(51) Int. Cl.[7] ..... B66D 3/04
(52) U.S. Cl. ..... 254/412
(58) Field of Search ..... 254/390, 412, 254/413, 414, 415, 416

(56) References Cited

U.S. PATENT DOCUMENTS 230,994 * 8/1880 Bitting ..... 254/412
352,539 * 11/1886 Handy ..... 254/412
360,050 * 3/1887 Redmond ..... 254/412
817,074 * 4/1906 Rose ..... 254/412
1,406,560 * 2/1922 Houghton ..... 254/412
3,528,645 * 9/1970 Harken ..... 254/412

FOREIGN PATENT DOCUMENTS

172753 * 12/1921 (GB) ..... 254/390

* cited by examiner

*Primary Examiner*—Emmanuel M. Marcelo
(74) *Attorney, Agent, or Firm*—Pyle & Piontek

(57) ABSTRACT

A bearing block has a head, a central hub, bearing means facilitating rotation of the sheave about the central hub. The block further has locking means for removably locking a length of high strength, fibrous material, such as cord, to the block for tethering the block to a boat deck or the like. The locking means may be a part of the block head, cheeks, or may be located at the block central hub. Preferred locking means are a plurality of passages for the cord ends to pass through, with set screws in two of the passages for removably holding the cord ends therein. A center portion of the cord length thus forms a loop for tethering the block.

35 Claims, 13 Drawing Sheets

BEARING BLOCK TETHER USING FINE LINES

CROSS REFERENCE

The present application claims the priority of U.S. Provisional Application No. 60/109,789 filed Nov. 25, 1998.

FIELD OF THE INVENTION

The present invention relates to a bearing block wherein the block has tethering means for attachment to a boat or the like.

BACKGROUND OF THE INVENTION

Bearing blocks are commonly used on sailboats for controlling and changing the direction of lines, to provide a mechanical advantage, or otherwise adjust the rigging. These blocks must be anchored to fixtures on the boat, such as padeyes, eyestraps, u-bolts, booms, and the like. Blocks are typically anchored to the fixtures by use of metal shackles, or by using a length of strap or webbing. Various disadvantages are associated with each of these anchoring configurations.

Anchoring a block by use of a metal shackle may require the use of a substantial shackle piece with an associated substantial weight. In addition, the metal shackle is rigid and not compact. Lightweight components are preferred for sailboats, particularly for performance type sailboats. Likewise, there is a desire in sailing to keep decks as clutter free as possible. This has led to interest in low profile bearing blocks, which may be kept close to the deck surface. Rigid metal anchor shackles for bearing blocks do not lend themselves well to these applications requiring low weight and low profile bearing blocks.

In order to address these problems, block anchor configurations utilizing a length of strap or webbing have been developed. These configurations offer comparable strength to metal anchors with the advantage of being significantly lighter. In addition, webbed or strapped configurations provide a lower profile block than a metal anchor can.

A disadvantage, however, that these webbed or strapped anchors share with metal anchors is that they may hamper movement of the block to a different location for use in alternate applications. There are a great number of places on a boat that a block may be attached. Some of these potential anchoring places, such as to a boat mast or boom, will not allow for use of a rigid metal anchor designed to be used with an eyelet or the like. Although a webbed or strapped anchor could be used in a variety of places on a boat, it will not easily be moved to a different location, as the web or strap anchor must be sewn on in place. Once sewn in place, the webbing must be cut to remove the block. Also, the process of sewing the web or strap in place requires a high degree of skill, particularly when a boat is in water and unsteady. The strap or web must be tightened to a desired tightness and then sewn while being held at this tightness.

An unresolved need therefore exists for more versatile light weight and low profile boat block tether configurations.

OBJECTS OF THE INVENTION

It is an object of the invention to provide a low weight boat bearing block that may be easily and removably attached to a boat deck or the like using lightweight strapping or cordage.

It is a further object of the invention to provide a bearing block with means for removably locking a tether to the block.

It is a further object of the invention to provide a boat block that may be attached to a boat deck or the like with the attachment load born by the center of the block.

SUMMARY OF THE INVENTION

The present invention generally comprises a bearing block having a head, a center hub connected to said head, bearing means, and sheave means, with the bearing means facilitating rotation of the sheave about the center hub. The block of the invention further comprises means for removably attaching and locking in place end portions of a length of high strength fibrous material, preferably rope or cordage, to the block, with the center portion of the length thereby forming a loop for tethering the block to a boat deck or like location. The block of the invention is preferably comprised of lightweight, high strength plastic.

In a preferred embodiment of the invention, the head and the central hub of the block each have a passage. End portions of the high strength fibrous material, preferably rope or cordage, are looped through the head passage and through the central hub passage. By looping the cord through the central hub, this preferred block offers various advantages of having the tethering load carried within the sheave. The block cheeks and head, for instance, may then be constructed of lighter weigh materials as they are not required to carry significant loads. In addition, should the block break or fail, the load will be effectively captured and retained by the tethering loop passing through the sheave.

In the preferred block, the rope ends may be removably locked in place proximate to the central hub passage by tying a stop knot or by otherwise fitting the cord end so that it will not be able to pass back through the passage. Or, more preferably, the block of the invention further comprises locking means for removably locking the cordage in place. Preferred cord locking means comprise an adjustable set screw that extends tangentially into the passage through a passage sidewall for removably locking the rope in place. For access to and adjustment of the set screw, the block sheave preferably has a passage through which a screwdriver, Allen wrench, or other suitable tool may be extended to adjust the bolt head.

In the most preferred block embodiment of the invention, the central hub has a first passage that is larger than a plurality of secondary central hub passages. The rope may be looped through the head passage and larger first passage a number of times, and then laced through each of the secondary passages a single time. Because the larger first hub passage contains several passes of the cord, the amount of load that the block may bear is much larger than would be allowed by a single cord. As the continuous rope is laced back and forth through the plurality of secondary passages, frictional resistance resiliently holding it in place increases. The rope ends may be knotted or otherwise configured to prevent them from passing back through a passage. As a preferred alternative to knotting, at least one of the plurality of passages, and preferably two, comprise the set screw locking means described above for removably locking the rope in place.

In addition to the preferred block of the invention, other embodiments comprise a block having cord locking means within the block head or side cheeks.

The high strength fibrous material of the invention preferably comprises small diameter cords and ropes with low stretch and low water absorption. It has been discovered that the block of the invention comprising these preferred cords and ropes provides a lighter weight block that eliminates the need for metal shackles, u-bolts, or other heavy structure tethering devices. The preferred cords are of small diameter, have good flexibility, and are thus easy to work with and give the block some ability to twist and auto-align with loads. The cords also have high tensile strength, thus providing the block of the invention with required load bearing strength.

The various embodiments of the block of the invention thus provide a lightweight block with high tensile tethering strength that eliminates the need for metal shackles, u-bolts, or other heavy structure devices for tethering it to a boat deck or the like. Also, there is no need to sew webbing in place for block tethering. The block of the invention may be easily removed and re-tethered. In addition, the cord may be easily cinched up tight to bring the block of the invention to an advantageous low position on the deck or other article to which it is tethered.

The above brief description sets forth rather broadly the more important features of the present disclosure so that the detailed description that follows may be better understood, and so that the present contributions to the art may be better appreciated. There are, of course, additional features of the disclosure that will be described hereinafter which will form the subject matter of the claims appended hereto. In this respect, before explaining a preferred embodiment of the disclosure in detail, it is to be understood that the disclosure is not limited in its application to the details of the construction and the arrangements set forth in the following description or illustrated in the drawings. The present invention is capable of other embodiments, of being practiced, and carried out in various ways, as will be appreciated by those skilled in the art. In addition, it is to be understood that the phraseology and terminology employed herein are for description and not limitation.

DETAILED DESCRIPTION

FIGS. 1–4: Preferred Embodiment

Figure 1:
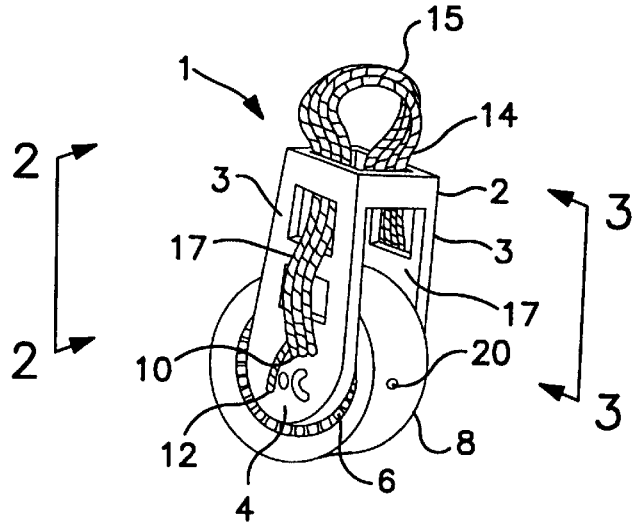
FIG. 1 is a perspective view of a preferred embodiment of the block of the invention.

Turning now to the drawings, FIG. 1 shows a perspective view of a preferred block of the invention. Block 1 comprises head 2 with arms 3 connected to central hub 4. Ball bearings 6 facilitate rotation of annular sheave 8 about central hub 4.

Central hub 4 has a first axial passage 10, and a plurality of smaller secondary axial passages 12. Head 2 also has passage 14. Passages 10, 12 and 14 are for passing and retaining high strength cord 15 for tethering block 1. Cord 15 is looped several times through head passage 14 and central hub first passage 10, with cord 15 ends laced through central hub secondary passages 12, where they will be removably locked in place. Cross member 17 connects side arms 3, with cord 15 passing over cross member 17 so as to avoid interference with the rotation of sheave 8.

Preferred cord 15 comprises a low stretch, low creep, and low water absorption cord of multiple intertwined thermoplastic polymer filament composition. ("Cord" as used herein is intended to be interchangeable with the term "rope".) The preferred ropes are generally made with a high strength fiber core, and a braided jacket of softer material, such as polyester. Materials of construction for the core of the preferred cord include, but are not limited to, Kevlar, a DuPont trade name for an aramid fiber, and Spectra, an Allied Signal trade name for polyolefin fibers. As the preferred block embodiment of the invention comprises a block for use on small boats, preferred cord diameters are generally between ⅛ inch and ½ inch. It is noted that the block of the invention would not be practical for many applications without use of such high tech cords that combine high tensile strength with a small diameter. The invention could not be practiced in a manner suitable for use in sailing, for instance, using cords comprised of organic fibers due to the diameter of cord required to achieve required tensile strength.

Commercially available examples of preferred cords include several available from the Yale Cordage Co., Biddeford Me.; including Crystalyne, Vectrus 12, Aracom-T, Aramid-T, and Light. Other commercial examples include several cords available from the New England Rope Co., Fall River Mass.; including T-900, Spect-set II, Sta-set, and Sta-set X. Still other commercial examples include Technora and Vectran. The tensile strength of the rope will of course vary with application. In addition, the preferred block of the invention allows for lashing with multiple strands, so that the total strength of the tethering line may be a multiple of its tensile strength.

Figure 2:
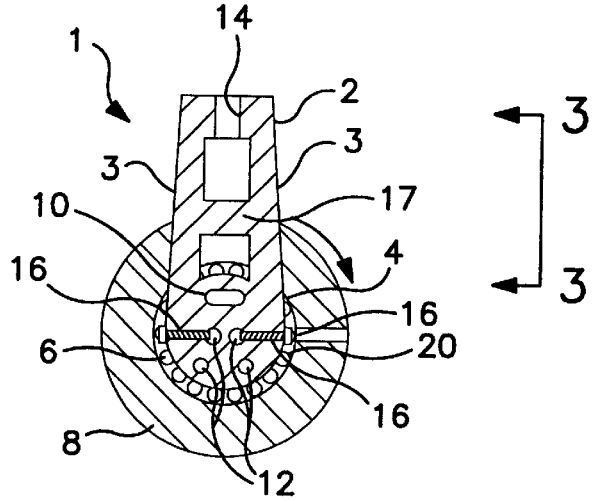
FIG. 2 is an elevational side view, shown partly in cross section, of the preferred embodiment of the block of the invention.

FIG. 2 is a side elevational view of the preferred embodiment of bearing block 1 of the invention, shown without cord 15. As generally shown in FIG. 1, FIG. 2 also illustrates block 1 comprised of head 2 with arms 3 connected to central hub 4. Ball bearings 6 facilitate rotation of annular sheave 8 about central hub 4. Central hub 4 has a first axial passage 10, and a plurality of smaller secondary axial passages 12. Head 2 also has passage 14. These passages are for passing high strength cord 15 of FIG. 1 for tethering block 1, with the cord looped several times through head passage 14 and central hub first passage 10, and the cord ends then laced through central hub secondary passages 12.

FIG. 2 also illustrates preferred locking means of set screws 16 for locking in place cord 15 ends in two secondary passages 12. Set screws 16 extend into two of secondary passages 12 for compressing against cord 15. Set screw 16 has a head for adjustment which is accessible through sheave passage 20 (also illustrated in FIG. 1). Sheave 8 may be rotated to a position where passage 20 is proximate one or the other of set screws 16 for adjustment thereof When cord 15 is present in secondary passage 12 with set screw 16, set screw 16 may be tightened, thereby forcing it downward into passage 12 and compressing against cord 15. Likewise, set screw 16 may be counter adjusted to retract it from passage 12, thereby releasing cord 15.

Figure 3:
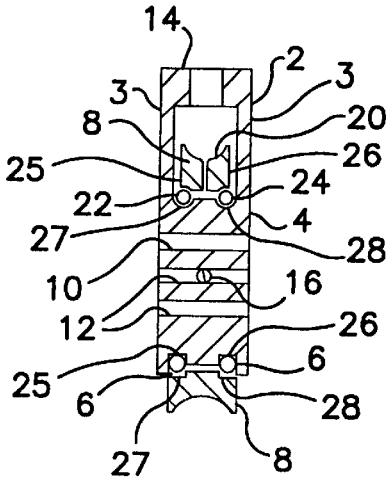
FIG. 3 is an elevational front view, shown partly in cross section, of the preferred embodiment of the block of the invention.

As is best illustrated in FIG. 3, set screw 16 head resides between two annular rings of bearings 6, in annular alignment with sheave passage 20. FIG. 3 also illustrates that ball bearings 6 comprise a first set 22 and a second set 24. Sheave 8 has a first annular race 25 and a second annular race 26, while central hub has a first annular race 27 and second annular race 28. First set of ball bearings 22 is rotatably engaged between race 25 and 27, with second set of ball bearings 24 rotatably engaged between race 26 and 28. Set screw 16 head is located between first set of annular bearings 22 and second set 24. The elevational partial cross section of FIG. 3 also illustrates the axial nature of central hub first passage 10 and secondary passages 12, with set screw 16 extending into two of secondary passages 12.

It is noted that the present invention is not limited to locking means comprising set screws 16 as illustrated in FIG. 2. In particular, the present invention as recited in the attached claims also comprises embodiments that removably lock cord 15 in place by use of stop knots, including by way of example a figure eight knot or a over-hand knot, tied in the cord ends to prevent the cord from passing through central hub passages 10 or 12. Other suitable means as are known in the art may likewise be comprised within the scope of the appended claims.

Figure 4:
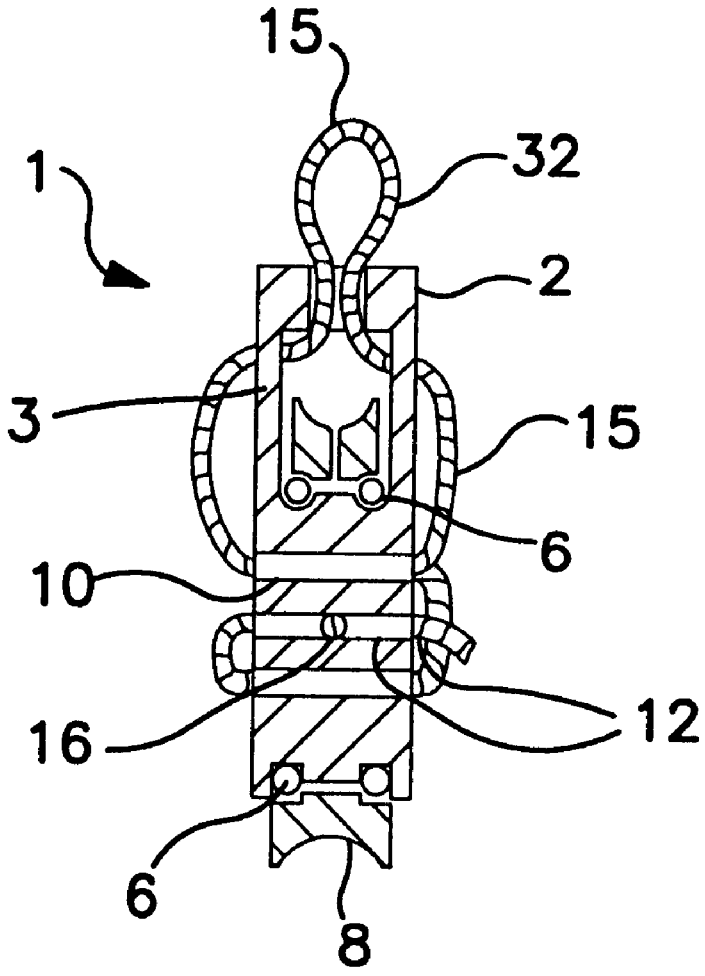
FIG. 4 is the same elevational front view as shown in FIG. 3 of the preferred embodiment of the block of the invention, with cord.

FIG. 4 illustrates the same view as FIG. 3, with preferred cord 15 of the invention in place. Cord 15 is passed a plurality of times through head passage 14 and central hub first axial passage 10, creating loop 32 for tethering block 1 to an eye strap or other attachment point on a boat deck. Loop 32 comprises a plurality of individual loops of cord 15. Cord 15 has its ends laced through central hub secondary passages 12, with the ends finally removably locked in place in secondary passages 12 by set screws 16.

As cord 15 is wrapped several times through hub first passage 10 below sheave 8, the load on sheave 8 will advantageously be carried at these positions. This allows for head 2 to be constructed of light weight materials, preferably molded composite plastics. Should head 2 or arms 3 break, sheave 8 will safely remain captive of cord 15 and its several loops through first passage 10.

To tether the block of the invention, one end of cord 15 may be locked in place in a secondary passage 12 with set screw 16. The second end of cord 15 is then laced through secondary passages 12, and looped a plurality of times through hub first passage 10 and head passage 14 and around a eye strap, boom, or other attachment point to which block 1 is to be tethered to. The second end of cord 15 is then laced through remaining secondary passages 12, drawn to a desired tension, and locked in place in secondary passage 12 with the second set screw 16. This advantageously allows for block 1 to be drawn tight to whatever it is tethered to for a low profile block. Further, even with tight, low profile tethering, block 1 remains free to twist somewhat in response to shifting loads because of the flexibility of cord 15.

Testing has shown that the preferred block of the invention, when constructed of lightweight molded plastic composites, and when using preferred cords as generally described above, achieves suitable working load capacities when using either the preferred locking set screw means or a tied stop knot. Further, the preferred block achieved a weight savings of 21% over a prior art block of the same size.

In addition to the preferred block embodiment of the invention described above, the invention may of course be practiced in a number of closely related configurations. Generally, these configurations comprise a block having locking means within the head of the block. The following Examples of additional block embodiments of the invention are of particular usefulness.

FIG. 5: Second Example

Figure 5A:
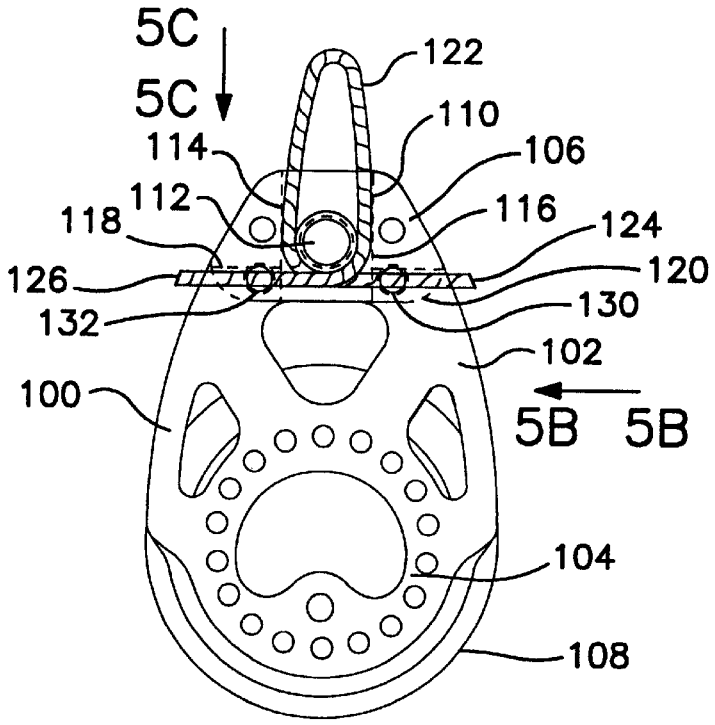
FIG. 5A is a side elevational view, partly in cross section, of a second example block of the invention.
Figure 5B:
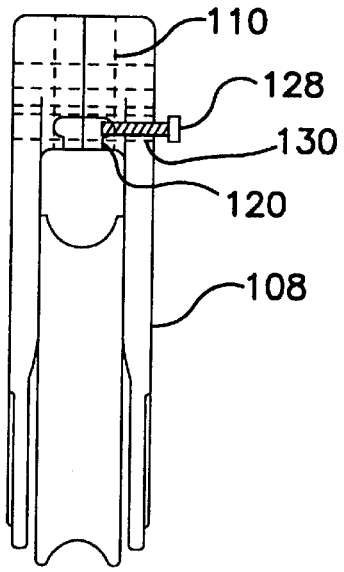
FIG. 5B is an end elevational view of the block of FIG. 5A.
Figure 5C:
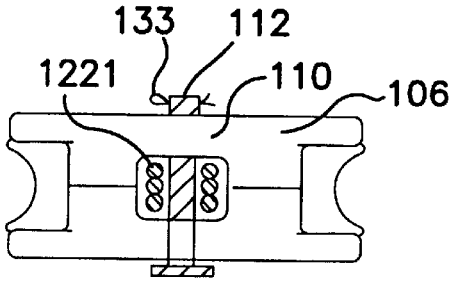
FIG. 5C is a top plan view of the block of FIG. 5A.

FIGS. 5A, 5B, and 5C show a second embodiment of the block of the invention, with locking means comprised within the head of the block. FIG. 5A is a side elevational view, partly in cross section, of block 100, which generally comprises side cheek 102, central hub 104, head 106, and sheave 108 rotatably mounted about central hub 104. A substantially vertical slot 110 (shown in broken line) extends through head 106, with cross pin 112 extending substantially horizontally through slot 110. Slot 110 has first side 114, and second side 116. A substantially horizontal passage intersects slot 110, with a first length 118 connecting to slot first side 114, and a second length 120 connecting to slot second side 116 (both lengths shown in broken line).

A length of high strength cord 122 has a first end portion 124 and a second end portion 126 extended through slot 110. Cord first end portion 124 passes along slot first side 114, by a first side of cross pin 112, then crosses slot 110 to exit head 106 through horizontal passage second length 120. In like manner, cord second end portion 126 passes along slot second side 116 by a second side of cross pin 112, then crosses slot 110 to exit head 106 through horizontal passage first length 118. In this configuration, cross pin 112 allows for the load on line end portions 124 and 126 to be well distributed, and advantageously prevents end portions 124 and 126 from contacting a sharp edge under load. An overall lighter weight head is also allowed for, as the load is concentrated on cross pin 112. Thus a resilient post 112, comprised of steel, for instance, may be combined with a relatively lightweight block head 106.

Cord end portions 124 and 126 are removably locked in place in passage lengths 118 and 120. FIG. 5B illustrates an end elevational view of block 100, with preferred threaded set screw 128 extending into passage length 120 for locking the cord in place. Referring once again to FIG. 5A, set screw 128 of FIG. 5B extends through hole 130. Likewise, a second screw extends through hole 132 into passage 118 to likewise lock cord second end portion 126 in place. As an alternative to set screws 128, stop knots may of course be tied in cord end portions 124 and 126 to removably lock them in place.

FIG. 5C shows a top plan view of block 100, with several passes of cord 122 comprised for additional tethering strength. FIG. 5C also illustrates cross pin 112 extending of block head 106, with a retaining pin 133 placed through it for retention.

FIG. 6: Third Example

Figure 6A:
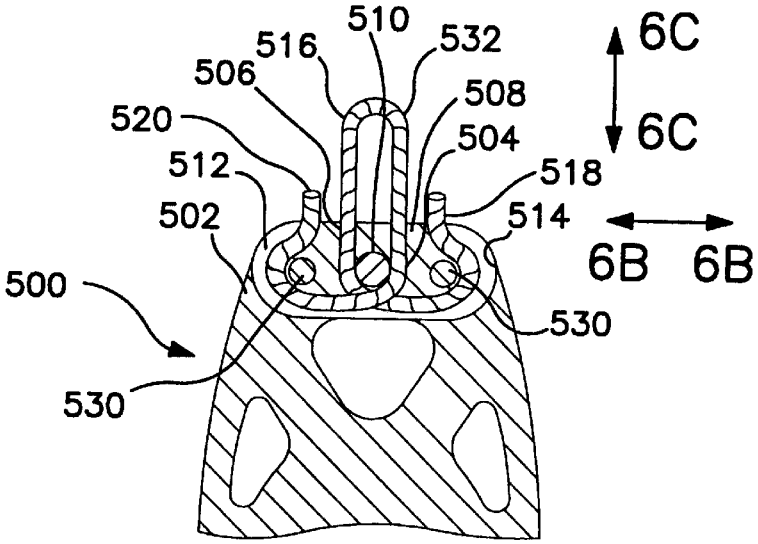
FIG. 6A is a side elevational view, partly in cross section, of the top portion of a third example block of the invention.
Figure 6B:
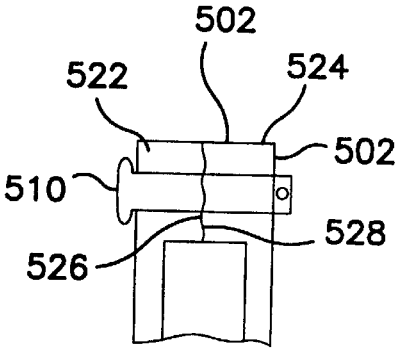
FIG. 6B is an end elevational view, partly in cross section, of the top portion of the block of FIG. 6A.
Figure 6C:
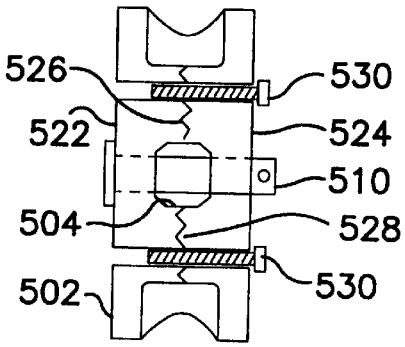
FIG. 6C is a top plan view in partial cross section of the block of FIG. 6A.

FIGS. 6A, 6B, and 6C illustrate an additional embodiment of the block of the invention similar to that shown in FIGS. 5A, 5B, and 5C. FIG. 6A illustrates a side elevational view, partly in cross section, of the top portion of block 500 of the invention. Block 500 generally comprises head 502, side cheeks 503, as well as a sheave rotatably mounted about a central hub (sheave and hub not illustrated). Head 502 has a substantially vertical slot 504 with a first side 506 and a second side 508. A cross pin 510 extends horizontally through slot 504. A first locking path 512 intersects with slot first side 506 below cross pin 510, with a second locking path 514 intersecting slot second side 508 also below cross pin 510. A cord 516 has a first end portion 518 passed along slot first side 506, wrapped around the bottom of cross pin 510, and extended along second locking path 514. Cord 516 has second end 520 which passes along slot second side 508, wraps around under cross pin 510, and extends along first locking path 512.

As illustrated in FIG. 6B, block head 502 has two sidewalls 522 and 524, with each having interengaging ridged inner walls 526 and 528. As illustrated in FIGS. 6A and 6C, adjustable locking screws 530 may be used to urge block head sidewalls 522 and 524 together. As this occurs, ridged interengaging inner walls 526 and 528 compress against and thereby resiliently engage cord end portions 518 and 520 in locking paths 514 and 512, respectively. As illustrated in FIG. 6A, a cord center portion 532 thereby forms a loop for tethering block 500.

FIG. 7: Fourth Example

Figure 7A:
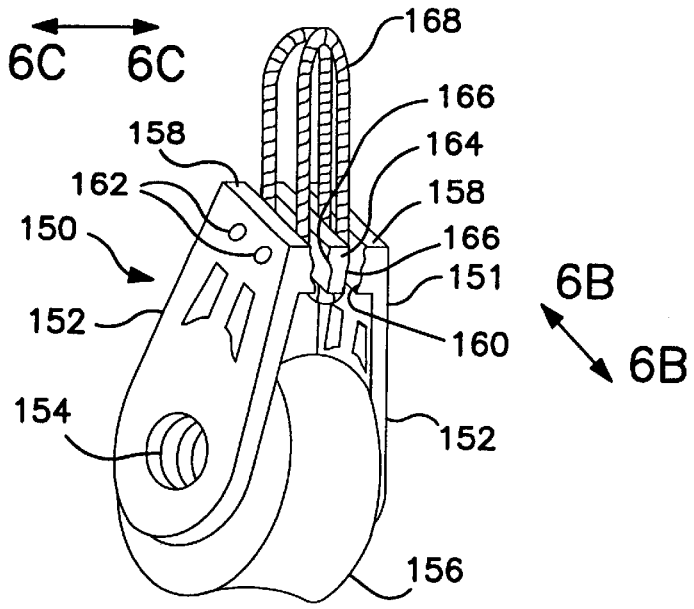
FIG. 7A is a perspective view of a fourth example block embodiment of the invention.
Figure 7B:
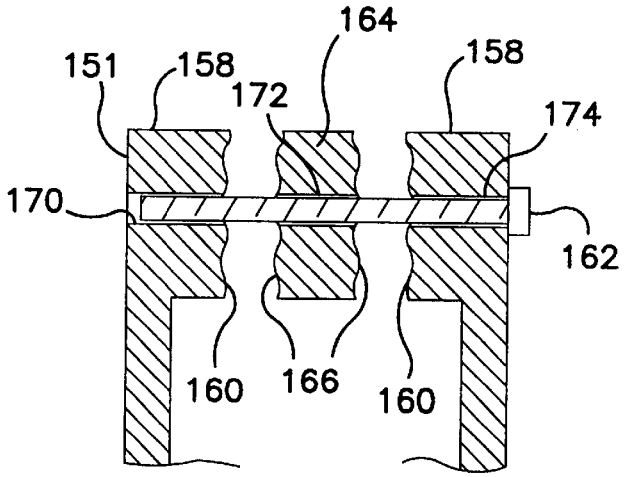
FIG. 7B is an end elevational view, partly in cross section, of the top portion of the block of FIG. 7A.
Figure 7C:
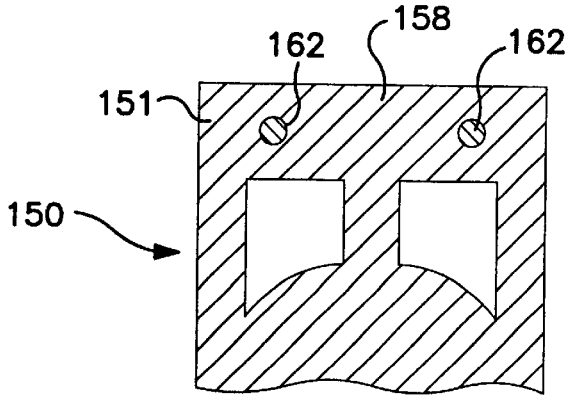
FIG. 7C is a side elevations view of the block of FIG. 7A.

FIGS. 7A, 7B, and 7C show another embodiment of the block of the invention, with the cord locking means again contained within the block head. Block 150 has head 151, cheeks 152 connecting a central hub 154, with a sheave 156 rotatably mounted about the central hub. Bearing means (not illustrated) facilitate rotation of sheave 156 about hub 154. Head 151 has two sidewalls 158, with a slot formed therebetween. Sidewalls 158 each have inside surfaces 160 a plurality of locking ridges. Two adjustable threaded locking screws 162 are for urging sidewalls 158 towards one another.

A central locking member 164 is contained within the slot between sidewalls 158. Central locking member 164 has two outside walls 166 that oppose sidewall inside surfaces 160. Locking member outside walls 166 have a plurality of locking ridges on them. A length of cord 168 is removably locked in place within head 151 by having its ends wrapped about central locking member 164, with sidewalls 158 then compressed towards one another and cord 168 end portions thereby removably locked in place between sidewall inside surfaces 160 and locking member outside walls 166.

FIG. 7B illustrates block head 151 from an end cross section view. Sidewalls 158 have ridged inside surfaces 160 in opposition to locking member 164 outside walls 166. FIG. 7B also illustrates first sidewall passage 170, central locking member passage 172, and second sidewall passage 174. Locking screw 162 passes freely through second sidewall passage 174, freely through central locking member passage 172, and is threadably received in first sidewall passage 170, to thereby urge sidewalls 158 towards central locking member 164. In addition to being threadably received, locking screw 162 could of course be fastened with a nut, or as otherwise may be known. Further, other means in addition to locking screw 162 may be used to urge block sidewalls 158 towards central locking member 164, including, but not limited to, clamps and the like. FIG. 7C illustrates a side elevational view of the upper portion of block 150, showing both locking screws 162.

FIG. 8: Fifth Example

Figure 8A:
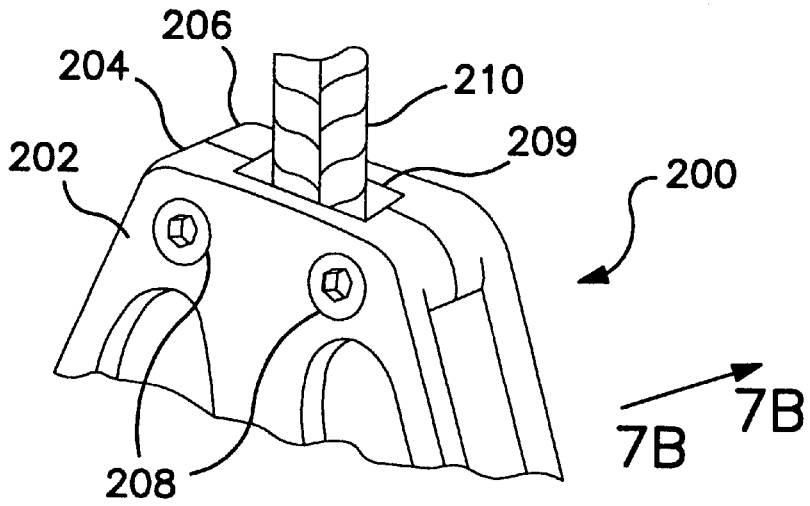
FIG. 8A is a perspective view of a fifth example embodiment of the block of the invention.
Figure 8B:
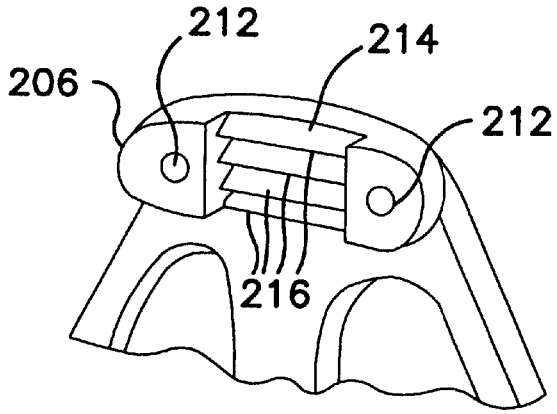
FIG. 8B is a perspective view of one sidewall of the block of FIG. 8A.

FIG. 8A and 8B illustrate perspective views of a block embodiment similar to that illustrated in FIGS. 7A–7C. As illustrated in FIG. 8A, block 200 upper portion has head 202, with two opposing sidewalls 204 and 206 urged towards one another by locking screws 208. A substantially vertical slot 209 is formed in head 202, with slot halves defined by recessed portions of sidewalls 204 and 206. A length of cord 210 has its ends removably locked in place in slot 209 between sidewalls 204 and 206, with a center portion of cord 210 thereby forming a loop (not illustrated) for tethering block 200. FIG. 8B illustrates a perspective view of the upper portion of sidewall 206 without central locking member 164. Passages 212 for receiving locking screws 208 of FIG. 8A are shown. Sidewall recessed portion 214 is also illustrated, which define half of slot 209. A plurality of locking ridges 216 or teeth are comprised along the surface of recessed portion 214 for enhanced gripping of cord 210 of FIG. 8A.

FIG. 9: Sixth Example

Figure 9A:
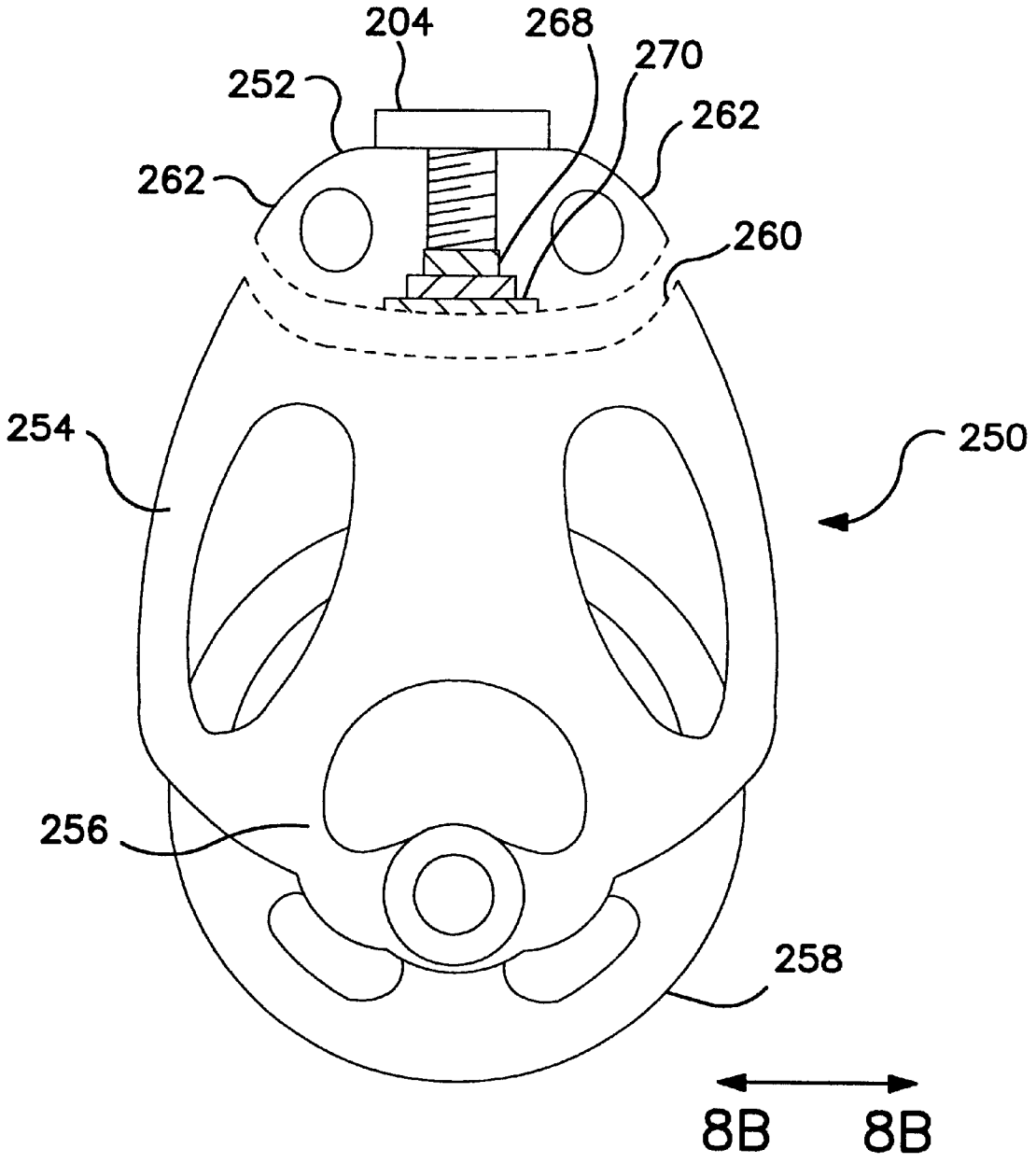
FIG. 9A is a side elevational view, partly in cross section, of a sixth example embodiment of the block of the invention.

FIG. 9A illustrates an elevational side view of an additional embodiment of the block invention. Block 250 generally comprises a head 252, side cheeks 254 connecting a central hub 256, and a sheave 258 rotatably mounted about hub 256. A first passage 260 (shown in dashed line) connects the two head endwalls 262. A locking screw 264 extends downward from the head top 266, and connects with spring 268 and sleeve press 270. Upon downward adjustment, locking screw 264 may extend sleeve press 270 downward into passage 260 to lock in place a strap extended through passage 260. Spring 268 operates to retract sleeve press 270 upon retraction of screw 264 to thereby clear passage 260 for insertion (or removal) of a strap.

Figure 9B:
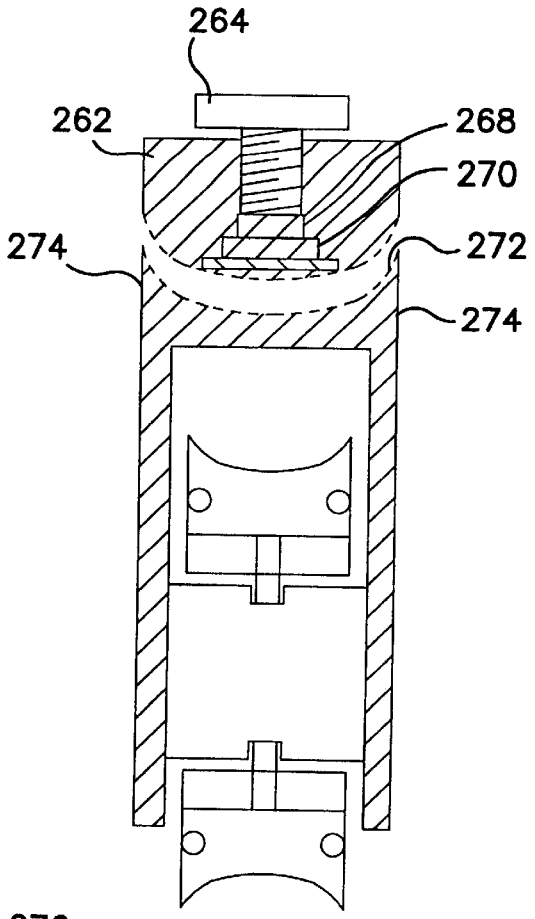
FIG. 9B is an end elevational view, partly in cross section, of the block of FIG. 9A.

FIG. 9B illustrates an elevational end view of block 250. In addition to the various elements common between views of FIGS. 9A and 9B, FIG. 9B also shows a second passage 272 which extends through head 262 substantially perpendicular to first passage 260. Second passage 272 connects opposing sidewalls 274 of head 264. Second passage 272 and first passage 260 intersect near their centers, under sleeve press 270. In this manner sleeve press 270 may be used to compress against a strap in either first passage 260 or second passage 272.

Figure 9C:
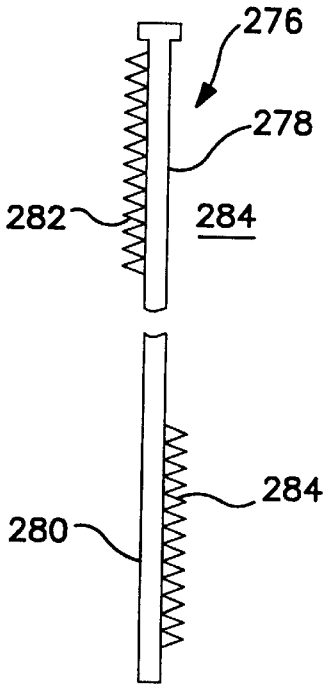
FIG. 9C is a side elevational view of the strap of the block of FIG. 9A.
Figure 9D:
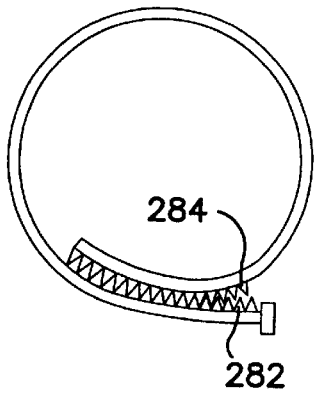
FIG. 9D is a side elevational view of the strap of the block of FIG. 9A.

FIGS. 9C and 9D offer two views of strap 276 appropriate for use with block 250. Strap 276 is preferably comprised of fiber reinforced plastic. FIG. 9C shows strap 276 having first and second end portions 278 and 280; each having a plurality of cooperating mating teeth, 282 and 284 respectively, on their surface. In operation, strap is looped through block 250, with the respective sets of mating teeth 282 and 284 interengaging one another as generally shown in FIG. 9D. The respective teeth sets 282 and 284 are interengaged within passage 272 or 260, with screw 264 and sleeve 270 firmly compressing against strap 276 for strong interengagement. In addition to preferred strap 276 with its mating teeth sets, other strap configurations may comprise mating fiber hook and loop sets of the sort commonly known as "Velcro".

Figure 9E:
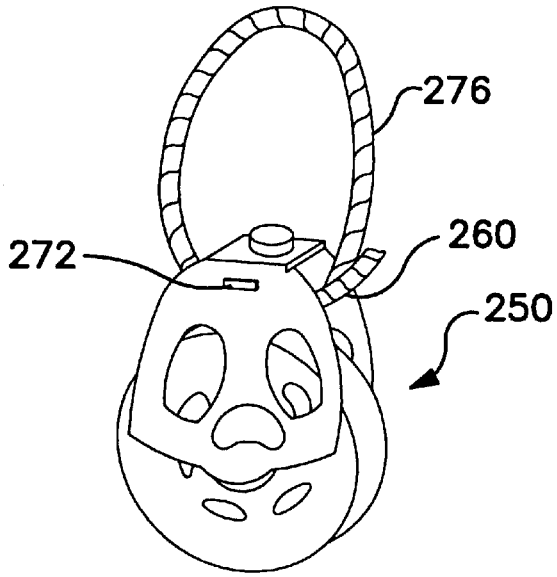
FIG. 9E is a perspective view of the block of FIG. 9A with the strap in a first orientation.
Figure 9F:
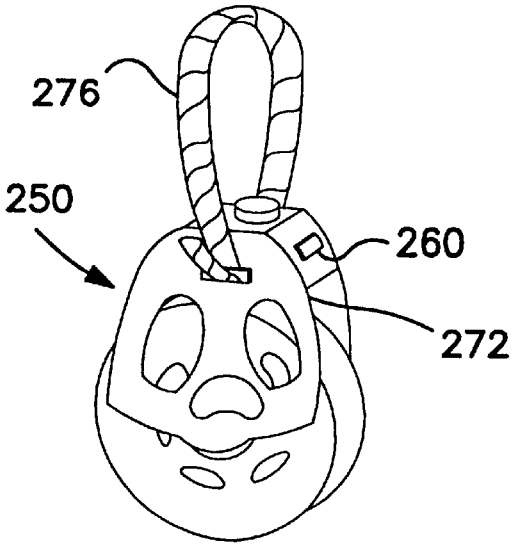
FIG. 9F is a perspective view of the block of FIG. 9A with the strap in a second orientation.

FIGS. 9E and 9F illustrate strap 276 inserted in first passage 260 and second passage 272, respectively. One or the other orientation may be desirable to achieve a desired tethering configuration.

FIG. 10: Seventh Example

Figure 10A:
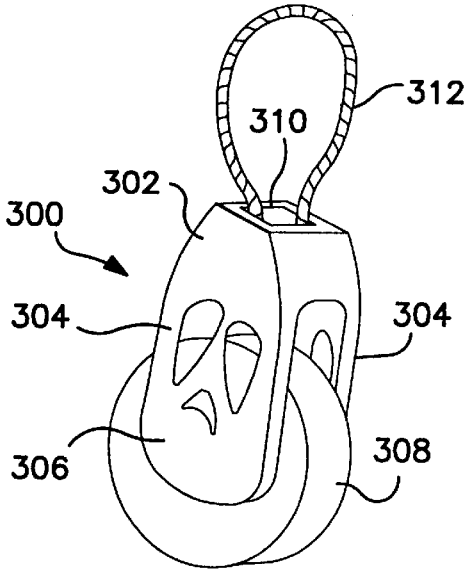
FIG. 10A is a perspective view of a seventh example embodiment of the block of the invention.
Figure 10B:
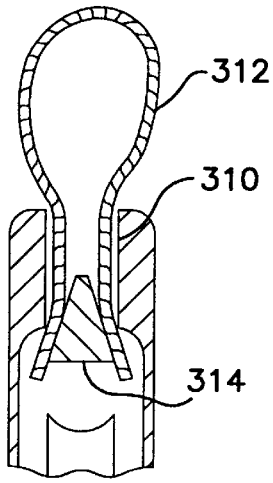
FIG. 10B is an end cross section view of the block of FIG. 10A.
Figure 10C:
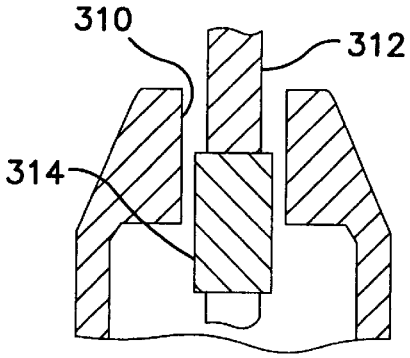
FIG. 10C is a side cross section view of the block of FIG. 10A.

FIGS. 10A, 10B, and 10C illustrate an additional embodiment of the block of the invention. Block 300 generally comprises a head 302, side cheeks 304, central hub 306, and sheave 308 rotatably mounted about hub 306. Head 302 has slot 310 through which strap 312 is removably locked in place. Fig 10B illustrates an end cross sectional view of block 300, with locking wedge 314 shown frictionally holding strap 312 in place in slot 310. FIG. 10C shows a side cross sectional view of block head 302 with wedge 314 removably locking strap 312 in place.

Figure 10D:
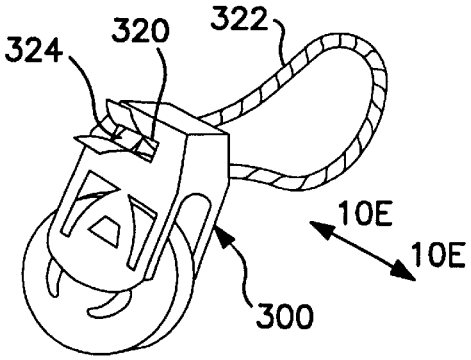
FIG. 10D is a perspective view of the block of FIG. 10A.
Figure 10E:
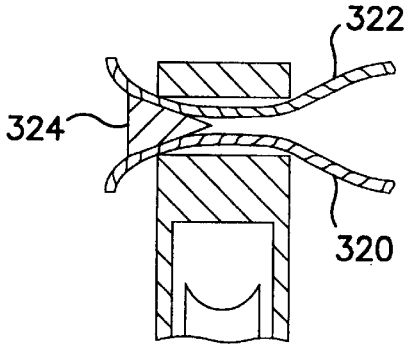
FIG. 10E is an end cross section view of the block of FIG. 10D.

As illustrated by the perspective view of FIG. 10D and the end cross sectional view of FIG. 10E, block 300 may alternatively have a slot 320 oriented in the horizontal, with a strap 322 removably locked in place by wedge 324. For versatility, block 300 may also comprise both the substantially vertical slot 310 of FIG. 10A and the substantially horizontal slot 320 of FIG. 10D, with the strap removably locked in one or the other of the slots as may be desired for a particular application.

FIG. 11: Eighth Example

FIGS. 11A, 11B, 11C, and 11D illustrate another embodiment of the block of the invention. Block 350 generally comprises head 352, side cheeks 354, central hub 356, and sheave 358 rotatably mounted about central hub 356. Head 352 has sidewalls 360 separated by a pair of transverse locking posts 362. A continuos loop of high strength cord 364 is threaded about locking posts 362 to form a locked in place tethering loop. Head sidewalls 360 are held together by a pair of locking screws 366 which extend through locking posts 362. To thread continuos loop 364, screws 366 may be removed to remove or separate sidewalls 360 for access to locking posts 362.

Figure 11A:
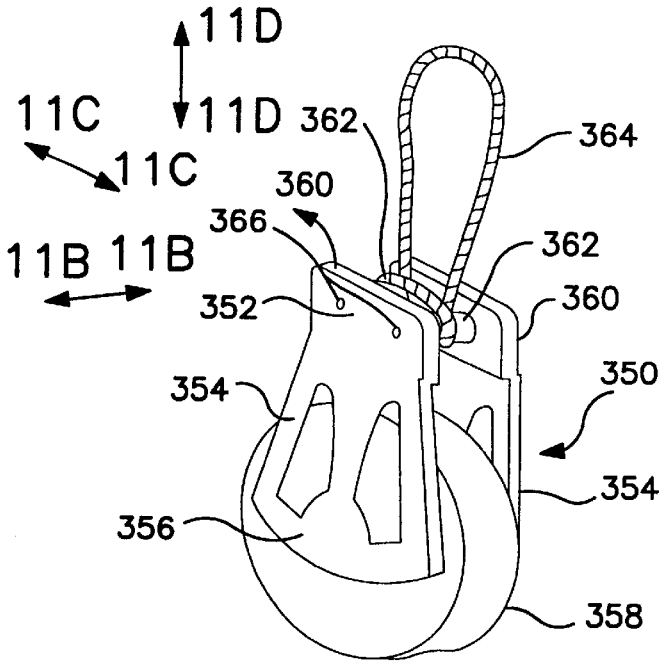
FIG. 11A is a perspective view of an eighth example block embodiment of the invention.
Figure 11B:
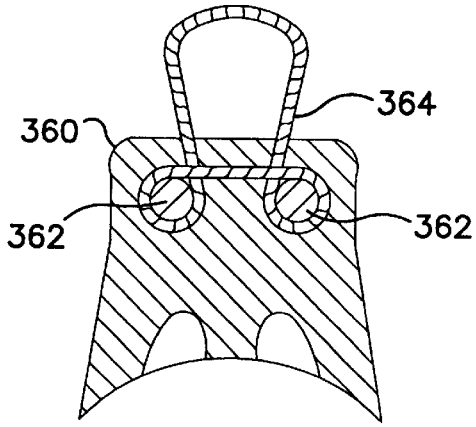
FIG. 11B is a side elevational cross sectional view of the top portion of block of FIG. 11A.
Figure 11C:
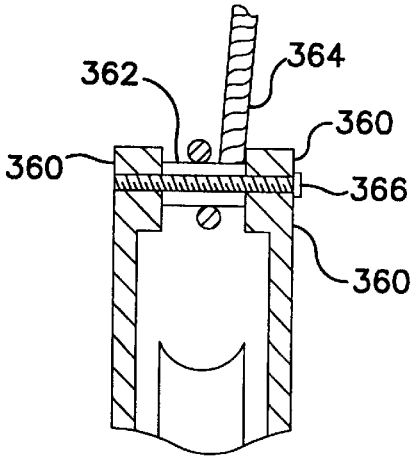
FIG. 11C is an end elevational cross sectional view of the top portion of the block of FIG. 11A.
Figure 11D:
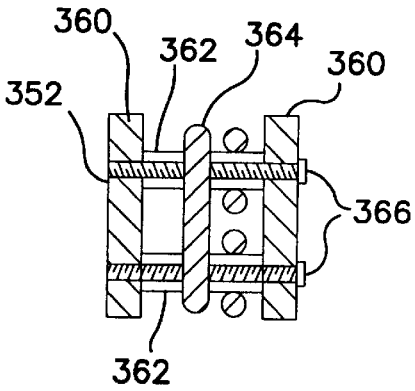
FIG. 11D is a top plan view of the top portion of the block of FIG. 11A.

FIG. 11B shows a side cross sectional view of posts 362 with one sidewall 360 removed, and continuos loop 3 64 threaded thereon. FIG. 11C shows an end cross sectional view with locking screw 366 extending through sidewalls 360 and locking post 362. FIG. 11D shows a top plan cross sectional view of head 352, also with locking screws 366 extending through sidewalls 360 and locking posts 362.

FIG. 12: Ninth Example

Figure 12B:
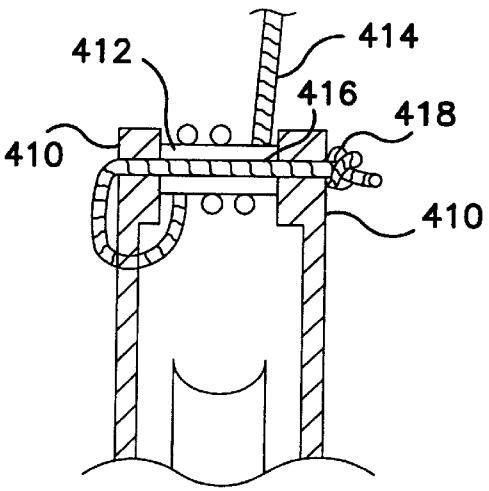
FIG. 12B is an end elevational view, partly in cross section, of the top of the block of FIG. 12A.
Figure 12C:
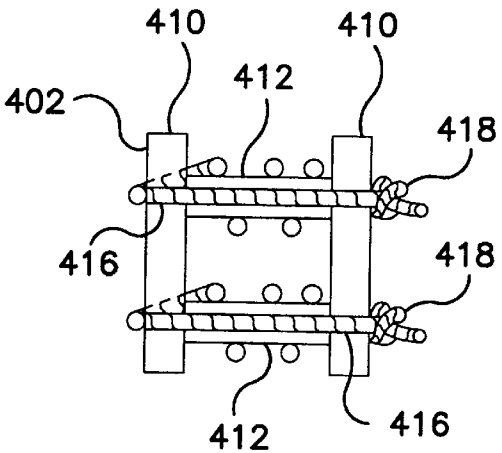
FIG. 12C is a top plan view of the head of the block of FIG. 12A.
Figure 12A:
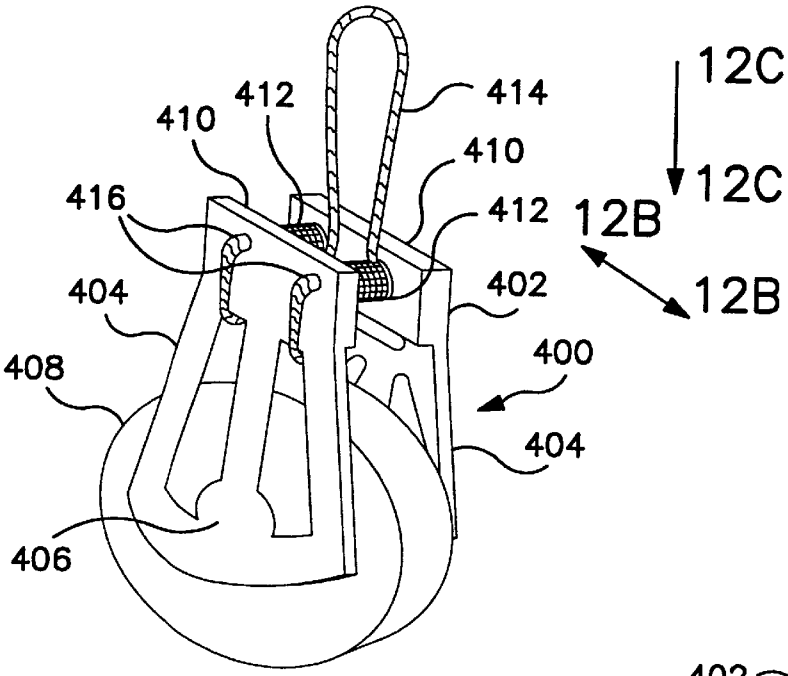
FIG. 12A is a perspective view of a ninth example embodiment of the block of the invention.

FIGS. 12A, 12B, and 12C illustrates yet another embodiment of the block of the invention which is similar in appearance to the block illustrated in FIGS. 11A–D. Block 400 generally comprises head 402, side cheeks 404, central hub 406, and sheave 408 rotatably mounted about central hub 406. Like block 350 of FIGS. 11A–D, head 402 of block 400 has sidewalls 410 separated by a pair of transverse locking posts 412. A length of cord 414 is wrapped about locking posts 412, with a central portion of cord 414 forming a loop for tethering block 400. The ends of cord 414 pass under sidewall 410 and through transverse passage 416 through sidewalls 410 and posts 412 to be removably locked in place therein.

As illustrated in the end cross sectional view of FIG. 12B, cord 414 ends may be locked in place by stop knots 418. As described above, cord 414 ends pass under head sidewall 410 and through transverse passage 416 through sidewalls 410 and posts 412, with stop knot 418 holding cord 414 in place. FIG. 12C illustrates a top plan view, partly in cross section, of head 402, with cord 414 locked in place after passing through transverse passage 416 and being knotted at 418.

FIG. 13: Tenth Example

FIGS. 13A, 13B, 13C, and 13D illustrate an additional embodiment of the block of the invention. This embodiment combines the preferred binding of the block central hub with locking the tether line in the head of the block. Block 600 comprises head 602, side cheeks 604, central hub 606, and sheave 608 rotatably mounted about hub 606. A length of high strength cordage 610 passes through vertical slot 612, through an opening in side cheek 604, and is wrapped through central hub 606. Cordage length 610 has its two free ends 614 removably locked in place in one each of locking channels 616 by locking set screws 618. Although not illustrated in FIG. 12A, a central portion of cord 610 forms a loop for tethering block 600 as has generally been shown in other FIGS. described above.

Figure 13C:
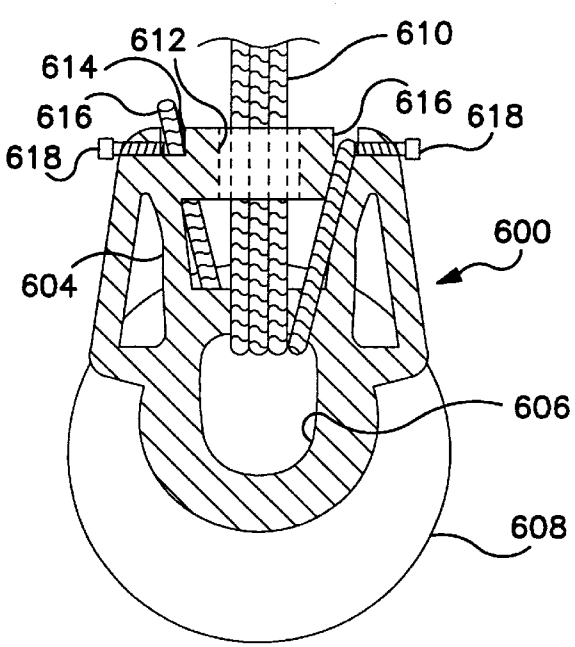
FIG. 13C is a side elevational view, partly in cross section, of the block of FIG. 13A.
Figure 13B:
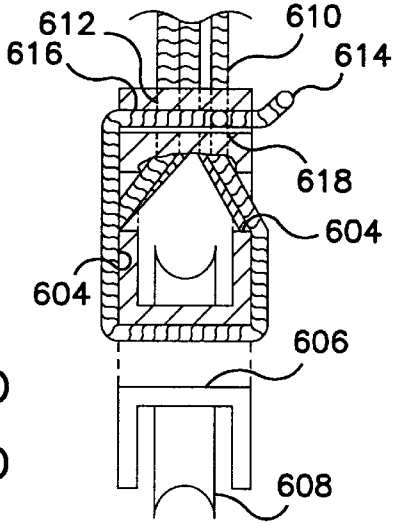
FIG. 13B is an end elevational cross section view of the block of FIG. 13A.
Figure 13D:
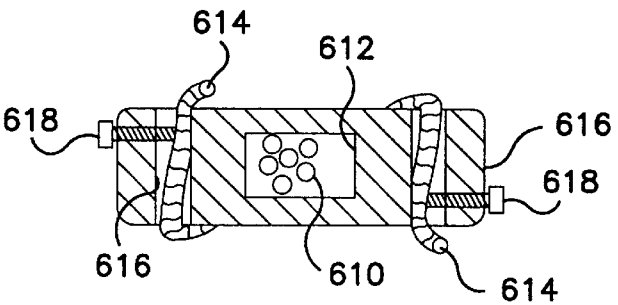
FIG. 13D is a top plan view of the block of FIG. 13A.
Figure 13A:
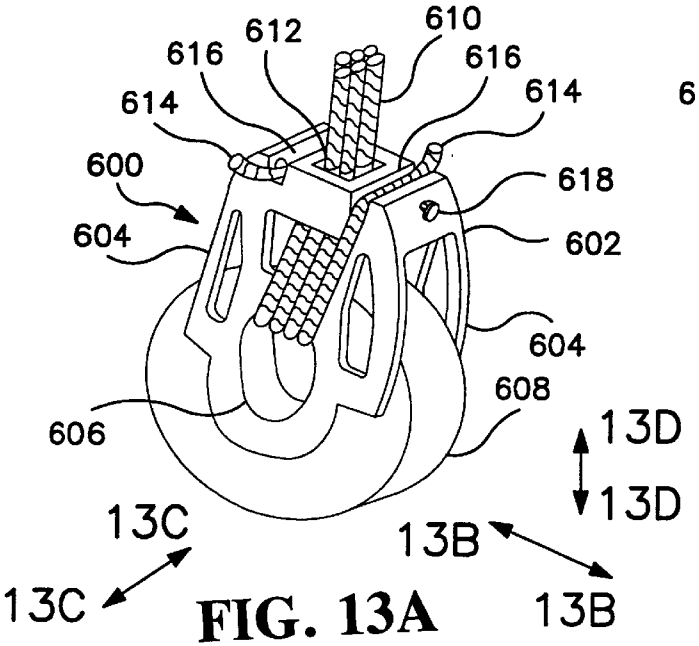
FIG. 13A is a perspective view of a tenth example embodiment of the block of the invention.

FIG. 13B is an end view, partly in cross section, and FIG. 13C is a side view, also partly in cross section, of block 600. As illustrated, cord 610 passes through slot 612 (shown in dashed line), out through an opening in side cheek 604, and wraps through central hub 606. Free end 614 is then removably locked in place in locking channel 616 by locking set screw 618. FIG. 13D is a top plan view of block 600 showing cord 610 in slot 612, with cord ends 614 removably locked in channels 616 by screws 618.

In addition to locking channels 616 as illustrated, it is further anticipated that this embodiment could alternatively utilize transverse passages through head 602, with cord ends 614 held in place by stop knots or set screws.

In the various embodiments described above that include the block head having sidewalls held together by threaded screws or bolts, the screws or bolts may be threaded directly into the plastic block sidewall. Or, more preferably, a threaded metal insert may be provided within the screw passage for receiving the screw. This may provide additional strength. Another means of joining sidewalls with a screw comprises a passage that is not threaded, with a threaded nut receiving the screw end exterior to the passage.

The advantages of the disclosed invention are thus attained in an economical, practical, and facile manner. While a preferred embodiment has been shown and described, it is to be understood that various further modifications and additional configurations will be apparent to those skilled in the art. It is intended that the specific embodiment herein disclosed is illustrative of the preferred and best modes for practicing the invention, and should not be interpreted as limitations on the scope of the invention as defined by the appended claims.

What is claimed is:

1. A bearing block comprising a head, a pair of side cheeks, a central hub connected to said head by said side cheeks, a sheave, bearing means for facilitating rotation of said sheave about said central hub; with said block head having locking means engaging a length of high strength fibrous material, said length of high strength fibrous material having two free ends; said locking means engaged proximate said free ends of said length, said fibrous material thereby removably locked in place with the center portion of said fibrous material thereby forming a loop for tethering the block.

2. A bearing block as in claim 1, wherein said head comprises two side walls, a slot therebetween, and means for urging said sidewalls toward one another; said high strength fibrous material passing through said slot, with said fibrous material firmly engaged by said sidewalls and thereby removably locked in place when said sidewalls urged towards one another.

3. A bearing block as in claim 2, wherein said urging means comprise a plurality of threaded locking screws.

4. A bearing block as in claim 2, wherein said head sidewalls have inside wall surfaces, a plurality of locking ridges on each of said inside surfaces for engaging said fibrous material.

5. A bearing block as in claim 2, wherein said means for urging said sidewalls towards one another comprise a plurality of threaded locking screws, and said locking means further comprising a cooperating center locking member between said head sidewalls in said slot, said center locking member having passages for passing said locking set screws, said fibrous material wrapped about said center locking member, said threaded locking screws adjustable to compress said sidewalls inwards towards said center locking member with said fibrous material thereby locked in place in said slot between said center locking member and said sidewalls.

6. A bearing block as in claim 5, wherein said center locking member having side surfaces with a plurality of locking ridges, and wherein said head side walls having inner wall surfaces with a plurality of locking ridges, said center locking member and side wall locking ridges for enhanced gripping of said fibrous material.

7. A bearing block as in claim 1, wherein said head having a top side and four sidewalls; and wherein said locking means comprise:

a) a first passage spanning an opposing two of said sidewalls, said fibrous material passing through said passage;

b) a threaded locking screw extending substantially vertically into said passage from said head top, said locking screw extending downward into said passage from said block head top side, said screw engageable against said fibrous material in said passage for removably locking said fibrous material in said passage.

8. A bearing block as in claim 7, wherein said high strength fibrous material comprises a strap having two ends and top and bottom side surfaces, at least a portion of said strap top surface and at least a portion of said strap bottom surface having means for lockingly engaging one another; said locking screw urging said top surface portion and said bottom surface interengaging means into interlocking contact in said slotted passage, with said strap thereby removably locked in place.

9. A bearing block as in claim 8, wherein said strap is comprised of fiber reinforced plastic, and said interengaging means comprise a plurality of interengaging teeth on said surfaces.

10. A bearing block as in claim 8, wherein said interengaging means comprise a set of fiber loops and fiber hooks for engaging said loops.

11. A bearing block as in claim 7, further comprising a second passage spanning the remaining two opposing of said sidewalls, said second passage having a central portion intersecting said first passage.

12. A bearing block as in claim 7, wherein said locking screw has a bottom end, and said screw further comprises a spring connecting said screw bottom end to a moveable sleeve press in said head above said first passage, said sleeve press engageable against said strap.

13. A bearing block as in claim 1, wherein said high strength fibrous material comprises a strap, and said locking means comprises a substantially vertical passage through said head, said strap having two end portions extending through said passage, a locking wedge having textured strap engaging surfaces firmly engaged between said strap end portions and at least partially within said passage; said wedge thereby removably locking said strap end portions in place in said head.

14. A bearing block as in claim 1, wherein said head having a top and a bottom, and further comprising a slot spanning said top and bottom, said central hub having a passage, said high strength fibrous material comprises cord having first and second end portions, and said locking means comprise at least two passages through said head, said cord first and second end portions passing through said slot, through said central hub passage, one each of said end portions removably locked in one each of said at least two passages; a center portion of said cord thereby forming a loop for tethering said block.

15. A bearing block as in claim 14, wherein said head having a top side, and said at least two passages comprise two slots open to said block top side having adjustable locking screws extending therein for removably securing said cord ends.

16. A bearing block as in claim 1, wherein said head having two sidewalls, a slot therebetween, and wherein said locking means comprise two substantially horizontal locking posts connecting said sidewalls and spanning said slot; at least one of said sidewalls removable; said high strength fibrous material comprising a continuous loop threaded about said locking posts and thereby removably locked in place to said head for tethering said block.

17. A bearing block as in claim 16, further comprising two threaded screws passing through said sidewalls, one each of said screws passing through one each of said locking posts, said sidewalls separable by adjusting said screws.

18. A bearing block as in claim 1, wherein said fibrous material comprises cord, and said head having two sidewalls, a slot therebetween, and wherein said locking means comprise two substantially horizontal locking posts connecting said sidewalls and spanning said slot; a continuous passage through said sidewalls and each of said locking posts; said cord having two end portions, one each of said end portions wrapped about one each of said locking posts, each of said end portions passing out of said slot and through one of said continues passages; said cord end portions removably locked in said passages by a stop knot.

19. A bearing block comprising a head, said head having top and bottom sides and four sidewalls, the bearing block comprising a pair of side cheeks, a central hub connected to said head by said side cheeks, a sheave, bearing means for facilitating rotation of said sheave about said central hub; with said block head having locking means engaging a length of high strength cord, said locking means engaged proximate the ends of said length, said length of cord thereby removably locked in place with the center portion of said length of cord thereby forming a loop for tethering the block; and wherein said locking means comprise:

a) a substantially vertical slot in said head spanning said head top and bottom sides, a substantially horizontal cross pin through said vertical slot; said vertical slot having first and second sides parallel to said cross pin;

b) a passage in said head spanning an opposing two of said sidewalls and intersecting said vertical slot below said cross pin, said passage having a first length coincident with said vertical passage first side, side passage having a second length coincident with said vertical passage second side; and c) said cord having first and second end portions, said cord first portion extended into said vertical slot along said first side, around a first side of said cross pin, crossed to said slot second side and extended into said passage second length, said cord second portion extended into said vertical slot along said slot second side, around a second side of said cross pin, crossed to said slot first side and extended into said passage first length, said cord first and second portions removably held in place in respective of said passage lengths.

20. A bearing block as in claim 19, wherein said locking means further comprising adjustable locking set screws engaged against said cord first and second end portions in said horizontal passage.

21. A bearing block as in claim 19, wherein said cross pin is removable, having a removable locking pin tangentially extending through said cross pin proximate said post end to lock said post in said head.

22. A bearing block as in claim 19, further comprising means for urging said sidewalls towards one another, and wherein said first and second passage lengths are substantially closeable by urging said sidewalls together with said means, respective of said cord end portions thereby removably locked in said first and second passage lengths when said sidewalls urged towards one another.

23. A bearing block comprising:

a) a head, a central hub connected to said head, a sheave, bearing means for facilitating rotation of said sheave about said central hub, said head having a substantially vertical passage therethrough, said central hub having an axial passage therethrough; and b) a length of high strength cord having two end portions extended through said head passage and through said central hub passage, said fibrous material end portions removably locked in place proximate said central hub, said length of cord having a center portion between said end portions creating a loop for tethering the block.

24. A bearing block as in claim 23, wherein said high strength fibrous material comprises rope, and said central hub has locking means for locking said rope in place in said central hub passage.

25. A bearing block comprising:

a) a head, a central hub connected to said head, a sheave, bearing means for facilitating rotation of said sheave about said central hub, said head having a substantially vertical passage therethrough, said central hub having an axial passage therethrough; and b) a length of rope having two end portions extended through said head passage and through said central hub passage, said rope removably locked in place by stop knots in each of said end portions preventing passage of said end portions back through said central hub passage; with a center portion of said rope between said end portions thereby forming a loop for tethering the block.

26. A bearing block comprising:

a) a head, a central hub connected to said head, a sheave, bearing means for facilitating rotation of said sheave about said central hub, said head having a substantially vertical passage therethrough; said sheave having a screw adjustment passage;

b) an axial passage through said central hub, said axial passage having a sidewall; an adjustable locking set screw extending through said passage sidewall and into said passage; said locking screw having a head, said head accessible through said sheave screw adjustment passage; and c) a length of high strength rope having two end portions extended through said head vertical passage and through said central hub axial passage, said adjustable locking set screw removably locking said rope end portions therein; said rope having a center portion between said end portions thereby forming a loop for tethering the block.

27. A bearing block comprising:

a) a head, a central hub connected to said head, a sheave, bearing means for facilitating rotation of said sheave about said central hub, said head having a substantially vertical passage therethrough, said central hub having a plurality of axial passage therethrough; and b) a length of rope having two end portions; said rope extending through said head passage and through said plurality of central hub passages, said rope end portions removably locked in place in two of said plurality of central hub passages.

28. A bearing block as in claim 27, wherein two of said passages having an adjustable locking set screw extending into said at least one passage for removably locking said rope therein.

29. A bearing block as in claim 28, wherein a) said set screw having a head, said sheave having first and second annular races, said central hub having first and second annular races;

b) said bearing means comprise a first set of ball bearings rotatably engaged between said sheave and hub first annular races and a second set of ball bearings rotatably engaged between said sheave and hub second annular races;

c) said set screw head between said hub first and second annular races; and d) said sheave having a passage for accessing said screw head.

30. A bearing block comprising:

a head, a central hub connected to said head, a sheave, bearing means for facilitating rotation of said sheave about said central hub, said head having a substantially vertical passage therethrough, a first axial passage through said central hub, a plurality of secondary smaller axial passages through said central hub; and a length of rope having two end portions, said length of rope looped through said head vertical passage and said central hub first passage a plurality of times, said rope passing through said plurality of central hub smaller secondary passages one time each; respective of said rope two end portions removably locked in place in two of said smaller secondary passages, a center portion of said rope thereby forming a loop for tethering the block.

31. A bearing block as in claim 30, wherein two of said secondary passages having locking means for removably locking said rope end portions therein, said locking means comprising an adjustable set screw extending into said passage for removably locking said rope in place.

32. A bearing block as in claim 31, wherein said set screw having a head, said bearing means comprise two annular sets of ball bearings, said set screw head between said two annular sets of ball bearings, said sheave having a passage for accessing said head.

33. A bearing block comprising:

a) a head, a central hub connected to said head, a sheave, bearing means for facilitating rotation of said sheave about said central hub, said head having a passage, said central hub having a first passage and a plurality of smaller secondary passages;

b) continuous rope looped through said head passage and through said central hub first passage a plurality of times thereby creating a rope loop for tethering the block, said rope passing through each of said central hub secondary passages once; and c) two adjustable locking set screws, one each of said screws extending into one each of two of said secondary passages, said set screws having heads, said sheave having a passage for accessing said heads to removably lock said rope in place in said respective passage.

34. A bearing block comprising:

a) a head, a central hub, two sets of two side arms connecting said head to said central hub, cross members connecting individual of side arms, a sheave, said head having a slot, said central hub having a first axial passage and a plurality of smaller secondary axial passages;

b) said hub having a first and a second annular race, said sheave having a first and a second annular race, a first annular set of ball bearings rotatably engaged between said sheave and hub first races, a second annular set of ball bearings rotatably engaged between said hub and sheave first and second races, said first and second sets of ball bearings facilitating rotation of said sheave about, said hub;

c) continuous rope looped through said head passage and through said central hub first passage a plurality of times thereby creating a loop for tethering the block, said rope passing between said side arms and over said cross members between said head passage and said central hub first passage, said rope passing through each of said central hub secondary passages once, said rope comprised of thermoplastic polymer strands; and d) two adjustable locking set screws, one each of said screws extending into one each of said central hub secondary passages, said set screws having heads between said hub first and second annular races, said sheave having a passage for accessing said heads to removably lock said rope in place in respective said passage.

35. A bearing block comprising a head, a pair of side cheeks, a central hub connected to said head by said side cheeks, a sheave, bearing means for facilitating rotation of said sheave about said central hub; with said block head having locking means engaging one and only one length of cord, said one length of cord having two free ends; said locking means engaged proximate said free ends of said one cord, said one cord thereby removably locked in place with the center portion of said one cord thereby forming a loop for tethering the block.

* * * * *